United States Patent [19]

Hoffmann

[11] Patent Number: 4,728,270

[45] Date of Patent: Mar. 1, 1988

[54] APPARATUS AND METHOD FOR REPLACING APEX SEALS IN A ROTARY DEVICE

[75] Inventor: Ralph M. Hoffmann, Eden Prairie, Minn.

[73] Assignee: Trochoid Power Corporation, Eden Prairie, Minn.

[21] Appl. No.: 920,722

[22] Filed: Oct. 20, 1986

[51] Int. Cl.[4] ..... F01C 1/00; F01C 21/00

[52] U.S. Cl. ..... 418/1; 418/61 B; 418/252

[58] Field of Search ..... 418/1, 252, 129, 144, 418/61 B, 127

[56] References Cited

U.S. PATENT DOCUMENTS

| | | | |
|---|---|---|---|
| 1,452,024 | 4/1923 | Campbell | 418/252 |
| 1,636,486 | 7/1927 | Planche | 418/54 |
| 3,036,527 | 5/1962 | Peterson | 418/252 |
| 3,193,186 | 7/1965 | Peras | 418/129 |
| 3,288,118 | 11/1966 | Abermeth | 123/8 |
| 3,366,317 | 1/1968 | Keylwert | 418/129 |
| 3,369,739 | 2/1968 | Abermeth | 418/129 |
| 3,721,218 | 3/1973 | Null | 123/8.11 |
| 4,460,321 | 7/1984 | Terauchi | 418/149 |

FOREIGN PATENT DOCUMENTS

| | | | |
|---|---|---|---|
| 2412398 | 10/1974 | Fed. Rep. of Germany | 418/252 |

*Primary Examiner*—Carlton R. Croyle
*Assistant Examiner*—Leonard P. Walnoha
*Attorney, Agent, or Firm*—Hill, Van Santen, Steadman & Simpson

[57] ABSTRACT

A rotary device and method for replacing apex seals is provided. The rotary device comprises a housing having a peripheral wall surface and two inner side walls that define a chamber. A rotor is located within the chamber and rotates therein. The peripheral wall surface of the housing includes a plurality of slots having disposed therein an insert, a wave spring, and an apex seal. The apex seal extends radially outward from the slot and is spring biased by the wave spring that is sandwiched between the insert and apex seal. The side walls of the housing include spring biased button seals. The button seals are urged against a portion of the apex seal. A side wall of the housing includes a rotatable nut for relieving the spring pressure on the button seal and an aperture covered by a removable cap for accessing the insert member so that it can be removed. A method of replacing the apex seals is also provided.

15 Claims, 4 Drawing Figures

FIG. 2
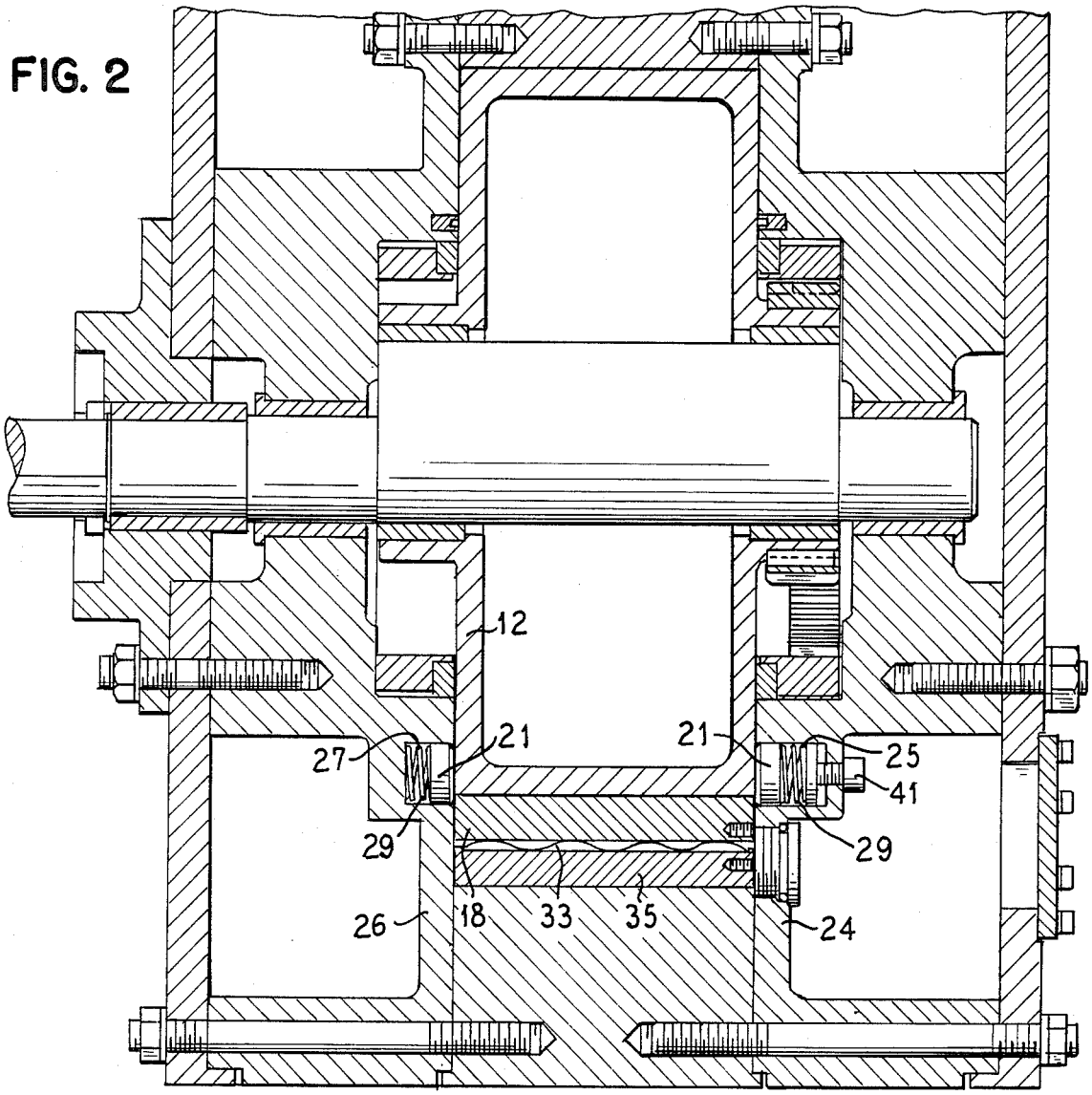
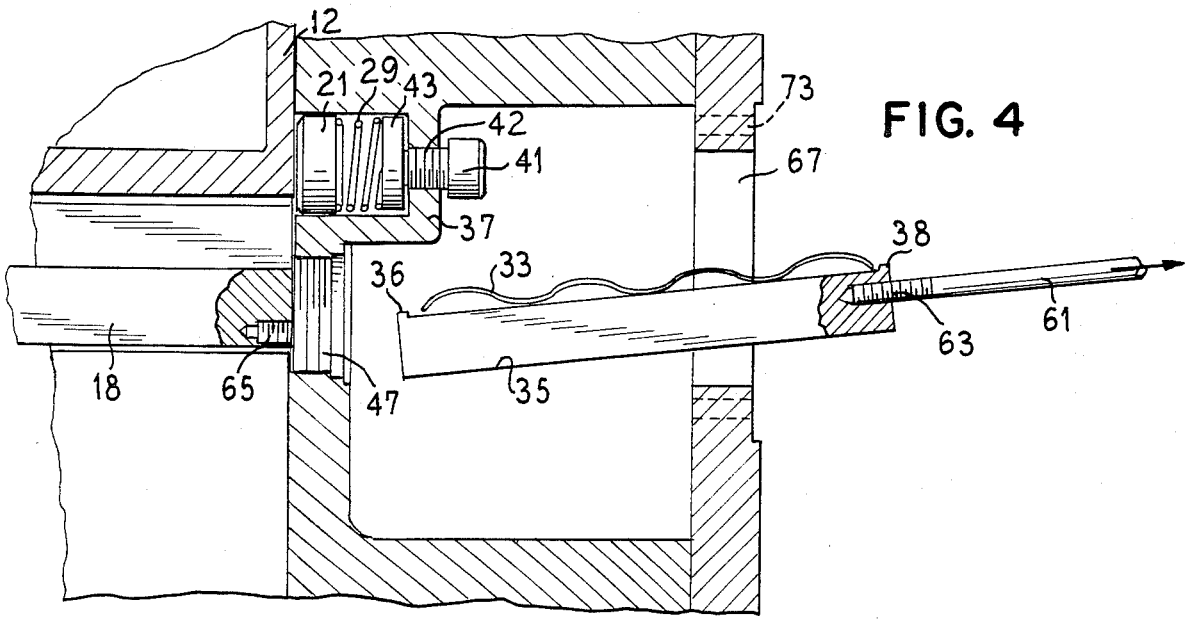
FIG. 4

APPARATUS AND METHOD FOR REPLACING APEX SEALS IN A ROTARY DEVICE

BACKGROUND OF THE INVENTION

This invention relates generally to rotary devices. More specifically, this invention relates to the replacement of the apex seals in such rotary devices.

Rotary devices, and specifically trochoidal rotary devices, are constructed so that a rotor planetarily rotates in a chamber defined by a housing. Trochoidal rotary devices can be divided into two groups: inner envelope devices; and outer envelope devices. In an inner envelope trochoidal device, the rotary assembly includes apex seals that cooperate with the inner wall surface of the housing to define a plurality of discrete chambers. In an outer envelope trochoidal rotary device the apex seals are mounted in slots in the inner wall of the housing between individual working chambers. The peripheral surface of the rotor assembly cooperates with the apex seals to define a plurality of discrete chambers.

Because the rotor cooperates with the apex seals and the inner wall housing to define the working chamber, the apex seals are subject to much destructive wear resulting from the sliding engagement of the peripheral surface of the rotor and seal in an outer envelope device, and seal and inner wall in an inner envelope device. Accordingly, it is necessary to replace the apex seals at regular intervals. Due to the construction of typical rotary devices replacing the apex seals usually requires disassembling the rotary device. This can be a very time consuming and expensive procedure.

Accordingly, there is a need for an apparatus and method for replacing the apex seals in a rotary device.

SUMMARY OF THE INVENTION

The present invention provides a rotary device and method for replacing apex seals. To this end, the rotary device comprises a housing having a peripheral wall surface and two inner side walls that define a chamber. A rotor is located within the chamber and rotates therein. The peripheral wall surface of the housing includes a plurality of slots having disposed therein an insert, a wave spring, and an apex seal. The apex seal extends radially outward from the slot and is spring biased by the wave spring that is sandwiched between the insert and apex seal. The side walls of the housing include spring biased button seals. The button seals are urged against a portion of the apex seal. At least one of the side walls of the housing includes means for relieving the spring pressure on the button seal and means holding the insert member so that it can be removed.

Preferably, the housing includes an outer side wall and an access plate for access to the means for relieving the spring pressure and means holding the insert member.

Preferably, the means for relieving the spring pressure on the button seal is a rotatable nut. Preferably, the means holding the insert member is a threaded aperture in the side wall that is covered by a removable threaded cap. Moreover, preferably the insert member and the apex seal include at one end a threaded aperture that cooperates with a rod that has a corresponding threaded portion so that the apex seal and insert member can be removed from the slot in the side wall.

A method for replacing the apex seal is also disclosed. The method includes removing an access plate located in an outer wall of the housing, relieving the spring pressure on the button seal, removing an access cap so that the insert member can be accessed, removing the insert member and wave spring, and then removing the apex seal. Once the apex seal is removed, a second apex seal can then be inserted into the slot in the peripheral wall of the housing. Once the second apex seal is inserted into the slot it is then urged radially outward from the slot and a wave spring and insert member are inserted into the slot beneath the apex seal. Once the second apex seal, wave seal, and insert member are properly placed in the slot, the spring pressure on the button seal is then reinstituted, the access cap is then replaced so that it covers the aperture in the side wall, and the access plate is then replaced so that it covers the aperture in the outer housing wall.

BRIEF DESCRIPTION OF DRAWINGS

FIG. 2 illustrates a cross sectional view of the trochoidal rotary device of FIG. 1 taken along lines II—II.

FIG. 4 illustrates the removal of the insert member and wave spring from the trochoidal rotary device of FIG. 3.

DETAILED DESCRIPTION OF THE PRESENTLY PREFERRED EMBODIMENTS

Figure 1:
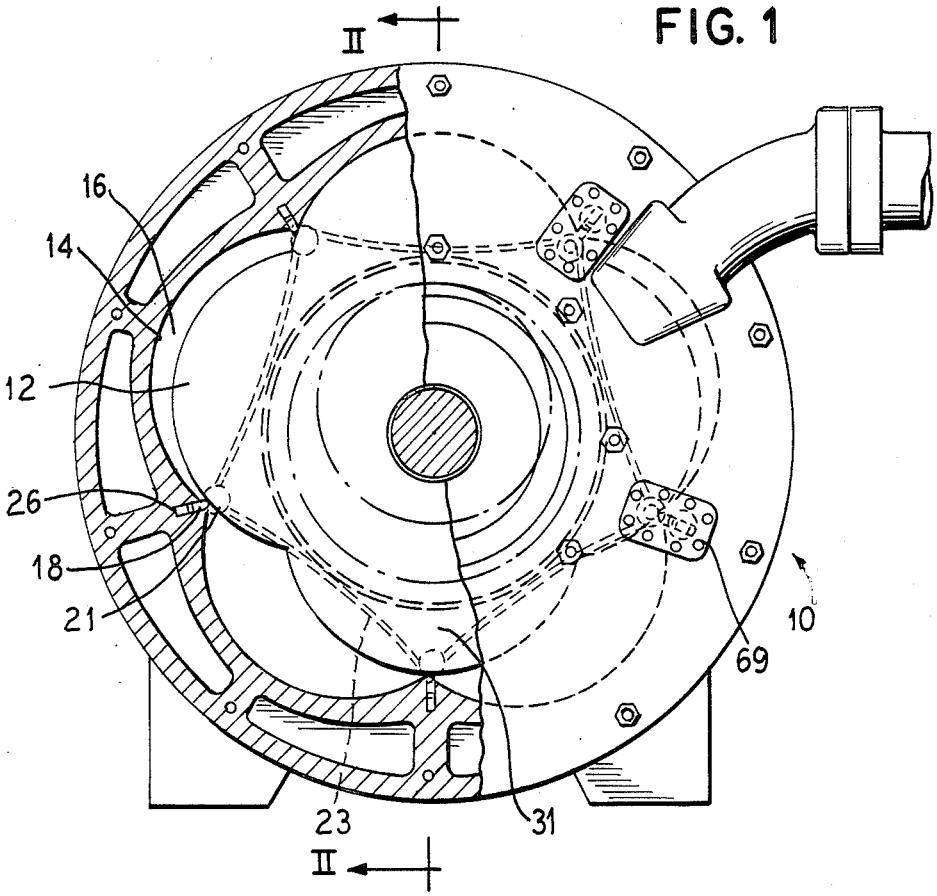
FIG. 1 illustrates a perspective view with parts broken away of a trochoidal rotary device.

The present invention provides an apparatus and method for replacing apex seals in a rotary device. FIG. 1 illustrates a typical rotary device 10. The rotary device 10 illustrated is an outer envelope trochoidal rotary device. As such, the rotor 12, has a peripheral surface that defines a trochoidal curve, and the housing cavity 14 has a profile that is the outer envelope of that curve. Variable spaces formed between facing peripheral surfaces of the rotor and housing serve as working chambers 16 for expansion engines, compressors, expanders, meters, and the like.

The working chambers 16 are sealed with radially extending apex seals 18 positioned along intersection lines between adjoining peripheral faces on the envelope curve surface. To this end, the peripheral wall of the housing includes a plurality of slots 26. The apex seals 18 are disposed within the slots 26. The rotor 12 planetates within the housing cavity 14 cooperating with the apex seals 18 to define working chambers. Accordingly, the rotor assembly 12 and the apex seals 18 cooperate to define a working chamber 16 in the rotary device 10.

The rotary device 10 also includes button seals 21 and arcuate seals 23. As illustrated in FIGS. 1 and 2, the button seals 21 are disposed within apertures 25 and 27 in the side walls 24 and 26 of the housing. The button seals 21 are biased outwardly by a spring member 29. Accordingly, as illustrated, the button seals 21 are urged against a portion of the rotor 12 and apex seals 18.

The button seals 21 cooperate with the apex seals 18 and arcuate seals 23 to seal the rotary device. To this end, the button seals 21 and arcuate seals 23 limit fluid flow from the internal rotor area 31 into the working chambers 16 and vice versa. For example, in an internal combustion engine this prevents the flow of gasoline from the working chambers 16 into the internal portions 31 of the rotor. The button seals 21 also cooperate with the apex seals 18 to seal the working chambers 16 against the peripheral surface of the rotor. Accordingly, a sufficiently tight seal must be achieved between the apex seals 18 and the button seals 21.

Figure 3:
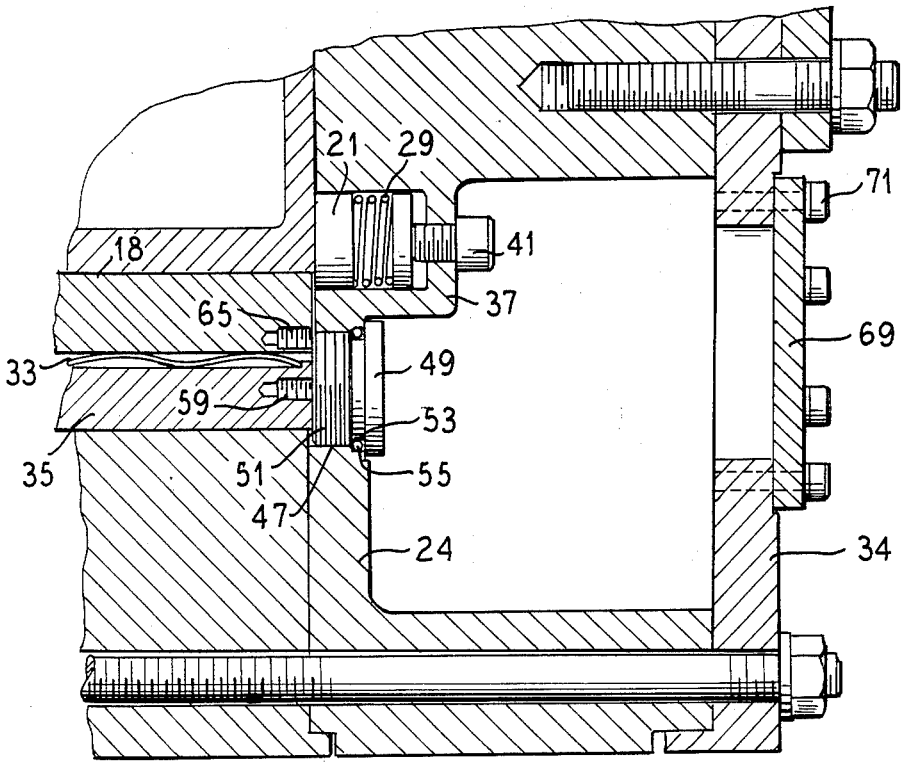
FIG. 3 illustrates a detail view of a cross-sectional portion of the trochoidal rotary device of FIG. 2.

Referring to FIGS. 2 and 3, the apex seals 18 are disposed within the slots 26 in the peripheral wall of the housing 14 and urged radially outwardly from the peripheral wall. To this end, a wave spring 33 biases the apex seal 18 outwardly. The wave spring 33 is situated in the slot 26 on an insert member 35. In the preferred embodiment illustrated, the insert member 35 includes flanges 36 and 38 against which each end of the wave spring 33 rests.

The side wall 24 of the housing is constructed so that it provides a means for removing and replacing the apex seals 18. To this end, an outer portion 37 of the side wall 24, that defines in part the aperture 25 for the button seal 21, includes a rotatable nut 41 that is received within a threaded aperture 42. The rotatable nut 41 is constructed so that it can relieve the pressure of the spring 29 that biases the button seal 21 outwardly.

It will be appreciated that the button seal 21 exerts a pressure on the apex seal 18 when it is being biased by the spring 29. Accordingly, in order to remove the apex seal 18, the spring pressure on the apex seal should be relieved. By rotating the nut 41 in a first direction, the nut is caused to extend into the threaded aperture 42 exerting a force against a plate 43 that is thereby urged against an end of the spring 29. This in turn increases the spring pressure on the button seal 21. By rotating the nut 41 in a second opposite direction, the nut 41 is caused to move out of the threaded aperture 42, consequently, the pressure against the plate 43 is relieved and the spring pressure on the button seal 21 is accordingly relieved. This in turn reduces the pressure exerted by the button seal 21 against the apex seal 18.

To provide a means for removing the apex seal 18, the side wall 24 includes an aperture 47 that is covered by a removable cap 49. The cap 49 is mechanically disposed over the aperture 47. Preferably, the aperture 47 is threaded and the removable cap 49 includes a threaded portion 51 that can be received within the threaded aperture 47. The threaded portion 51 includes an annular slot 53 for receiving an o-ring 55. The o-ring 55 helps to seal the aperture 47 when the removable cap 49 is received within the aperture.

The aperture 47 allows access to the insert member 35 so that the insert member 35, wave spring 33, and apex seal 18 can be removed. To this end, the removable cap 49 can be removed by rotating the cap in a first direction. Of course, the removable cap can be constructed so other means can be utilized to secure it within the aperture 49 and remove it therefrom.

Preferably, the aperture has a shape that is slightly larger than the cross-sectional size of either the insert member 35 with wave spring 33 or apex seal 18—whichever is greater. Accordingly, as illustrated in FIG. 4, the insert member 35, wave spring 33, and apex seal 18, can be easily removed from the aperture 47 when the cap 49 is removed. To this end, preferably, the insert member 35 includes at one end a threaded aperture 59 that cooperates with a tool 61, in the form of a rod 61 that has a threaded portion 63 that can be received within the threaded aperture therein. To remove the insert member 35, the threaded portion 63 of the rod 61 is threaded into the threaded aperture 59 and the insert 35 can thereby be removed through the aperture 47. Once the insert 35 and wave spring 33 are removed from the slot 26, the apex seal 18 will fall down into the position previously occupied by the insert.

The apex seal 18 also preferably includes at one end, a threaded aperture 65 that can receive the threaded end portion 63 of the rod 61. Accordingly, after the insert 35 is removed the apex seal 18 can then be removed by the rod 61. It should be appreciated that other mechanisms for engaging the seal 18 and insert 35 on the tool 61 could be similarly utilized as part of the invention. For example, corresponding magnetic elements or hook and gripper elements could be used.

The housing of the rotary device 10 includes an outer wall 34 that circumscribes the outer peripheral surface of the rotary device 10.

To provide access to the side wall 24, and specifically the rotatable nut 41 and access cap 49, the outer wall 34 of the housing includes a rectangular aperture 67 that is covered by a removable plate 69. The rectangular aperture 67 provides access to the rotatable nut 41 and access cap 49. The access plate 69 is preferably removably secured to the outer wall of the housing 34 by bolts 71 that are received within apertures 73. Accordingly, to remove the access plate 69 the bolts 71 are removed from the corresponding apertures 73. Of course, other means of removably attaching the access plate 69 over the aperture 67 to the outer wall 34 of the housing can be utilized.

To replace the removed apex seal 18, a second apex seal is located in the slot 26 through the aperture 47 in the side wall. The second apex seal is then urged radially outward into the housing cavity 14 and then the insert 35 with the wave spring 33 is inserted into the slot 26. Once the second apex seal, wave spring 33, and insert member 35 are inserted in the slot, the rotatable nut 41 is tightened and the cap 49 is reinserted into the threaded aperture 47 of the side wall 24. The access plate 69 is then positioned over the rectangular aperture 67 and bolted to the outer housing wall 34.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A rotary device comprising a rotor, a housing having a cavity in which the rotor rotates, the cavity defined by an inner peripheral surface and two side walls, the inner peripheral surface including a plurality of slots having disposed therein an insert, wave spring, and apex seal, the apex seal extending radially outward from the slot and being spring biased by the wave spring, the wave spring being sandwiched between the apex seal and insert member, at least one of the side walls of the housing including an access aperture for accessing the insert, wave spring, and apex seal, the access aperture being covered by removable cap, the side walls also having apertures in which are disposed a plurality of spring biased button seals, the button seals being biased outwardly from the side walls against a portion of the apex seal, and at least one of the side walls further including means for relieving the spring pressure on the button seal, the means including a plate, located at one end of the aperture between the button seal and spring, and a rotatable bolt that causes the plate to move towards the button seal when the bolt is rotated in a first direction and causes the plate to be biased away from the button seal when it is rotated in a second direction.

2. The rotary device of claim 1 wherein the housing includes an outer side wall surrounding at least a portion of the side wall that includes the means for relieving the spring pressure and removable cap, the outer side wall including an access plate for allowing access to the means for relieving the spring pressure and the removable cap.

3. The rotary device of claim 1 wherein the insert member and apex seal include at an end a threaded aperture.

4. The rotary device of claim 1 wherein the aperture for accessing the insert, wave spring, and apex seal is threaded and the removable cap includes a corresponding threaded portion.

5. A trochoidal rotary device comprising a housing having a cavity defined by an inner peripheral surface and two side walls, the inner peripheral surface including a plurality of slots having disposed therein an insert, an apex seal, and sandwiched therebetween a wave spring, the wave spring urging the apex seal radially outward from the slot, the side walls having disposed therein a plurality of spring biased button seals, the button seals being biased against a portion of the apex seal and rotor, at least one side wall includes a rotatable bolt for relieving the spring pressure on the button seal and an access aperture for accessing the insert, wave spring, and apex seal the access aperture being covered by a removable cap, the button seals being disposed in apertures in the side walls, a plate is located at one end of the apertures between the button seal and spring, the rotatable bolt causes the plate to move towards the button seal when the bolt is rotated in a first direction and causes the plate to be biased away from the button spring when the bolt is rotated in a second direction.

6. The rotary device of claim 5 wherein the housing includes an outer side wall having an access plate for allowing access to the rotatable nut and the removable cap.

7. The rotary device of claim 5 wherein the insert member includes at an end a threaded aperture.

8. The rotary device of claim 5 wherein the apex seal includes at an end a threaded aperture.

9. The rotary device of claim 5 wherein the aperture for accessing is threaded and the removable cap includes a corresponding threaded portion.

10. The rotary device of claim 9 wherein the removable cap includes an o-ring.

11. A method of removing an apex seal from a rotary device having a rotor and a housing, the housing having a cavity, in which the rotor rotates, defined by an inner peripheral surface and two side walls, the inner peripheral surface including a plurality of slots having disposed therein an insert, an apex seal, and sandwiched therebetween a wave spring, the wave spring urging the apex seal radially outward from the slot, the side walls including apertures having disposed therein a plurality of button seals, the button seals being spring biased by a spring outwardly from the side walls including means for releasing the spring pressure from the button seal, the means for releasing the spring pressure including a rotatable nut contacting a plate located at an end of the aperture of the side wall, and a removable cap that covers an aperture for accessing the insert member, and the housing including an outer wall having an access plate, comprising the steps of:

removing the access plate;

rotating the rotatable nut causing the plate to move away from the spring in a first direction relieving the spring pressure on the button seal;

removing the removable cap;

removing the insert member and wave spring; and removing the apex seal.

12. The method of claim 11 including the steps of:

removing the insert member by inserting a threaded rod into a threaded aperture in the insert member; and removing the apex seal by inserting a threaded rod into a threaded aperture in the apex seal.

13. A method of replacing an apex seal in a rotary device having a rotor and a housing, the housing having a cavity, in which the rotor rotates, defined by an inner peripheral surface and two side walls, the inner peripheral surface including a plurality of slots having disposed therein an insert, an apex seal, and sandwiched therebetween a wave spring, the wave spring urging the apex seal radially outward from the slot, the side wall having apertures in which are disposed a plurality of button seals, the button seals being spring biased by a spring outwardly from the side walls against a portion of the apex seal, at least one of the side walls including a rotatable nut for releasing the spring pressure from the button seal, the rotatable nut contacting a plate located at an end of the aperture of the side wall, and a removable cap for covering an aperture for accessing the insert member, and the housing including an outer wall having an access plate comprising the steps of:

removing the access plate;

rotating the rotatable nut causing the plate to move away from the spring in a first direction relieving the spring pressure on the button seal;

removing the removable cap;

removing the insert member and wave spring;

removing the apex seal;

inserting a second apex seal in the slot;

urging said second apex seal radially outward in the slot;

inserting the wave spring and insert in the slot;

replacing the removable cap;

rotating the rotatable nut in a second direction causing the plate to move toward the spring and causing the spring to bias the button seal outwardly; and replacing the access plate.

14. The method of claim 13 including the steps of:

removing the insert member by inserting a threaded rod into a threaded aperture in the insert member; and removing the apex seal by inserting a threaded rod into a threaded aperture in the apex seal.

15. The method of claim 13 including the steps of:

relieving the spring pressure on the button seal by rotating the rotatable nut in a first direction; and causing the spring to bias the button seal by rotating the rotatable nut in a second direction.

* * * * *